United States Patent [19]

Petaway et al.

[11] 4,380,269

[45] Apr. 19, 1983

[54] QUICK RELEASE FIRE HOSE CABINET

[76] Inventors: John B. Petaway, 2021 Brooks Dr., Suitland, Md. 20746; Otis C. Gabriel, Abrahms Hall Box 1448, Walter Reed Army Hospital Center, Washington, D.C. 20012

[21] Appl. No.: 319,043

[22] Filed: Nov. 6, 1981

Related U.S. Application Data

[62] Division of Ser. No. 157,444, Jun. 9, 1980, abandoned.

[51] Int. Cl.[3] ..... A62C 35/00

[52] U.S. Cl. ..... 169/51; 137/355.28; 248/92

[58] Field of Search ..... 169/51; 248/91, 92, 248/93; 239/289, 447; 137/355.16, 355.28

[56] References Cited

U.S. PATENT DOCUMENTS

| | | | |
|---|---|---|---|
| 153,060 | 7/1974 | Fairchild | 239/447 |
| 1,049,136 | 12/1912 | Noble | 248/93 |
| 1,155,262 | 9/1915 | Mock | 248/92 X |
| 1,556,123 | 10/1925 | Nuhring | 248/92 |
| 3,722,800 | 3/1973 | Shames et al. | 239/447 |
| 4,231,400 | 11/1980 | Friedling et al. | 239/447 X |

*Primary Examiner*—Howard N. Goldberg
*Assistant Examiner*—Fred A. Silverberg

[57] ABSTRACT

The present invention consists of a wall mounted cabinet in which there is stored a readily released length of flexible hose, one end of which is connected to a water source in the cabinet with a valve and the other end having a nozzle of the garden variety which can be utilized not only to direct the flow of water, but to control the flow. The device can be mounted adjacent any available source of water and can be operated readily by a child as well as handicapped or elderly persons.

2 Claims, 8 Drawing Figures

QUICK RELEASE FIRE HOSE CABINET

This is a Division of application Ser. No. 157,444, filed June 9, 1980, now abandoned.

FIELD OF THE INVENTION

The present invention is in the field of fire safety and more particularly is a device which permits the prompt combating of a small fire with a continuous stream of pressurized water while awaiting the arrival of organized fire fighting units.

BACKGROUND OF THE INVENTION

The problem of combating fire in both commercial and residential buildings has a long history and continuing efforts are being made to not only detect fire at an early stage, but to provide means with which fires can be extinguished or at least controlled pending the arrival of proper fire-fighting equipment. Commercial buildings rely principally upon sprinkler systems installed in the ceilings and certain residential buildings may be required to have sprinkler systems in their hallways or general public areas. Portable fire extinguishers are available for fighting all three classes of fires, and are generally provided in multi-family occupied buildings. Also, in some buildings there are fire standpipes in hallways or stairwells containing a conventional fire hose and appropriate water controls. Most of the portable fire fighting equipment used in commercial buildings and multiple occupancy buildings is of the conventional chemical type fire extinguisher of 2½ gallon capacity. These are heavy pieces of equipment to use and are almost impossible for use by children, the elderly, and persons with physical disabilities. Small portable fire extinguishers are available for positioning in occupied spaces, but they generally are of limited capacity and, in many instances, because of lack of requirement for periodic inspection, are allowed to deteriorate or become essentially useless due to loss of pressure or decomposition of the contents.

The problem of fires is particularly acute in the United States. It has been reported that in New York City alone there are more building fires each year than in all of France and Germany. Statisitics indicate that on an annual basis, fires kill over 12,000 people of which over 2,000 are children, and each day sufficient fires cause damage in excess of $20,000. Most people do not appreciate how quickly even a small fire can erupt into an inferno. A small fire can accelerate to a flash point, which is a situation where free supply of oxygen allows the flames to spread with explosive force. Even when fires do not go beyond a smoldering stage they can be just as quickly fatal as an actual fire. An increase or production of as little as one percent of carbon monoxide, which is a by-product of all combustion, can cause unconsciousness in seconds and death within three minutes. Most people never have and probably never will be caught in even a minor fire. Since such is not a daily experience, most people are totally unprepared when confronted by a fire and as a result, take actions which instead of combating the fire tend to assist the fire in its development. For example, people will attempt to carry the burning objects, for example, a pillow, sofa cushion, or burning wastebasket, from the burning area in which case they generally end up by igniting other materials along the way or burning themselves. They may rush out into the hall to get the chemical fire extinguisher which most probably will allow the influx of a fresh volume of air, which will cause the fire to accelerate in its development. In other instances, they will attempt to throw the burning object through a window which results in an influx of air again causing the fire to expand even more rapidly. As a result of such reactions to fire, thousands of apparently otherwise quite sensible people die in fires every year. Recently, a team of psychologists at Surrey University in England decided to find out why, and particularly with respect to fires in family-occupied areas. It was found to be a common occurrence that when someone discovers a small fire in his living area such as a wastepaper basket or a mattress, sofa cushion, or trashbasket, that he would rush off for a bucket of water or a pan of water and throw it on the fire and then run back and get another bucket of water, and continue to take such actions, probably leaving the door opened to facilitate movement, which adds to the fire and as a result is generally unable to extinguish the fire. It is apparent that when discovering a fire most people would attempt to put it out. However, means presently available for such are considered inadequate either because of the inability of the person to utilize the presently available portable fire extinguishing equipment or because of lack of other means for combating the fire.

SUMMARY OF THE PRESENT INVENTION

The present invention provides means whereby upon discovering a fire, the fire can be combated by use of a continuous flow of pressurized water which can be directed at the fire from a safe distance and a device which is readily available and can be used throughout most inhabited or occupied areas.

BRIEF DESCRIPTION OF THE DRAWINGS

The present invention in various illustrative embodiments may be seen in the following drawings in which.

DETAILED DESCRIPTION OF THE DRAWINGS

Figure 1:
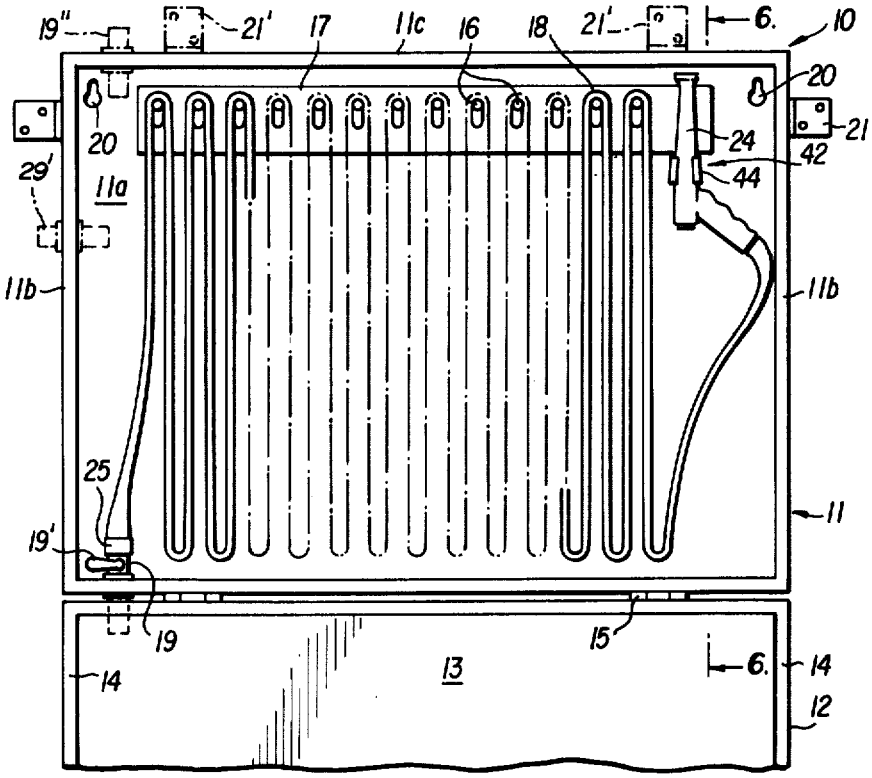
FIG. 1 is a front elevation view of one embodiment of the present device.
Figure 2:
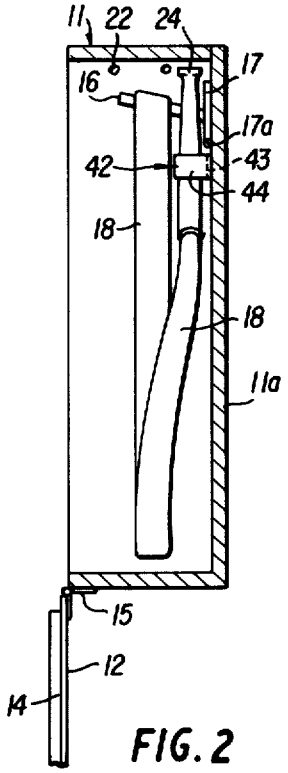
FIG. 2 is an enlarged view in partial cross-section of the invention in FIG. 1 showing the means for retaining the hose.

The present invention comprises a storage cabinet for a fire hose and is identified generally by numeral 10. The cabinet comprises a hose storage compartment 11 having a back wall 11*a*, side walls 11*b* and top wall 11*c*, and bottom wall 11*d*. The inner surface 13 of the door 12 has a peripheral recess 14 which permits the cover to be closed completely to provide a general seal of the inside of compartment 11. The cabinet is designed to be installed vertically as shown. The back wall 11*a* of compartment 11 provides a plurality of pegs 16 mounted perpendicularly to the back wall. As can be seen in FIG. 1 and FIG. 2, the pegs 16 are mounted on a support plate 17 which in turn is pivotally attached by pin 17a (FIG. 2) to the back wall 11a of a compartment 11. The pegs 16 are angled upwardly from plate 17 to retain the loops of the hose 18 when placed thereon and yet allow rapid removal of the hose from the cabinet when the need arises. The hose 18 may be a very flexible, resilient, plastic material or it may be a conventional hose which may be flattened when not in use, and comprises generally a fabric cover with a plastic liner in those instances in which the fabric cover is not in itself waterproof. The flattened type hose is preferable since it is more easily stored and more easily moved about than the conventional circular cross-section hose. One end of the hose has attached thereto a nozzle 24 which is the well-known garden-type single-trigger type and is readily connectible to the hose 18.

As seen more clearly in FIG. 2, the nozzle is placed in clip assembly 42 which commprises a base plate 43 secured to back wall 11a below one end of hose support plate 17 and a U-shaped clip 44 secured to plate 43 to hold nozzle 24. When nozzle 24 is in clip 44, it holds hose support plate 17 against wall 11a. Removal of the nozzle allows plate 17 to pivot forward and release the hose. The other end of the hose 18 carries a nipple 25 which is attached to the water supply conduit as shown in FIG. 1 as 19. The conduit 19 may be positioned as shown in FIG. 1 or in the side wall 11b as seen at 29', or in the top wall 11c as seen at 19''.

Since the cabinet is to be installed on a vertical building wall as a preferable installation, there are provided several means for attaching the cabinet to the wall. There is illustrated in the drawings the use of key-hole openings 20 in the upper corners of the back wall 11a of the cabinet which are used in the conventional manner by placing them over previously positioned studs or screws, or other means which could be driven into a vertical supporting member for the cabinet. It is also within the scope of the present invention to employ flanges as illustrated at 21 which may be attached to the end walls 11b of the cabinet as shown in FIG. 1 or could be attached to the top wall 11c of the cabinet at 21'. It is also within the scope of the present invention that the flanges could comprise flat plates mounted on the side walls of the compartment 11 for attachment to studs.

While it is believed that the tight fit of the lid 12 to the storage compartment 11 would be accomplished by the peripheral flange 14 bearing against the walls of compartment 11, it is also within the scope of the present invention to include additional cover securing means (not shown). These additional means should normally consist of a more simple detent-type securing means since it is essential that the cover be opened readily with minimum force when the need to utilize the hose therein arises.

Figure 6:
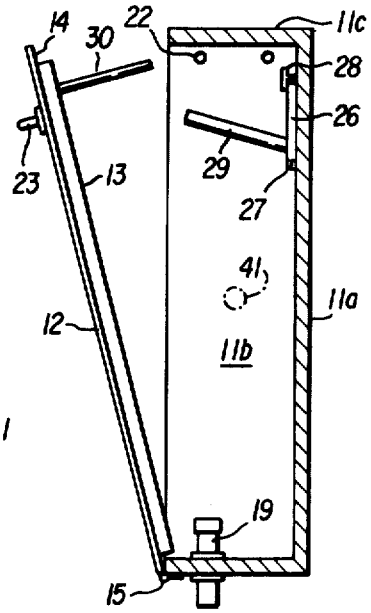
FIG. 6 is a partial cross-section of another hose retaining means along plane 6—6 in FIG. 1.
Figure 7:
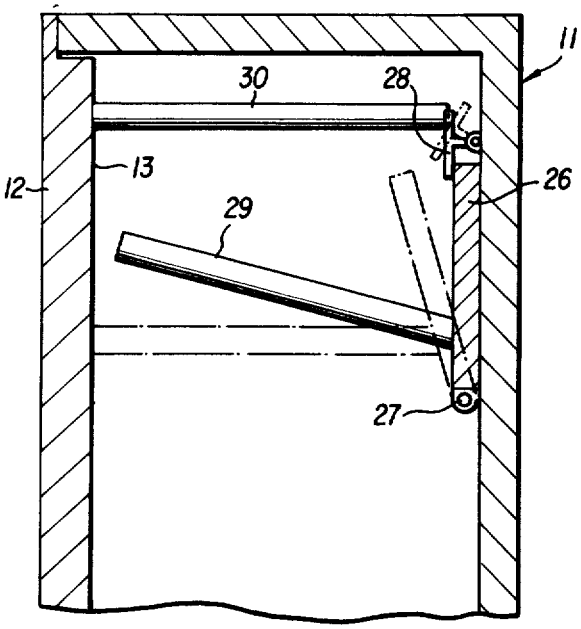
FIG. 7 is an enlarged view in cross-section of the hose retaining means shown in FIG. 6.

Referring now to FIGS. 6 and 7, it will be seen that the principal difference between the hose storage rack seen in FIGS. 1 and 2 as contrasted with that in FIG. 6, is that, while the plate 26 is pivotally attached at 27 to the back wall 11a of the compartment 11, a simple catch 28 holds the plate 26 against the back wall in lieu of the nozzle 24. Additionally, there is attached to the inner surface 13 of the cover 12 a rod 30, as will be seen in FIGS. 6 and 7, which is utilized to actuate the catch 28. This embodiment could be used in the following manner. With the catch 28 holding the plate 26 against the back wall, the hose is looped over the plurality of rods 29 as the hose is shown looped in FIG. 1. In this position with the cover opened, the hose will not slide off rod 29 by its own sheer weight. When the cover 12 is closed, the rod 30 strikes the upper part of catch 28, and moves it into the position shown in dotted lines in FIG. 7, thus removing it from contact with plate 26. With the catch 28 removed from its holding position, plate 26 will pivot outwardly to the position shown in dotted lines in FIG. 7. This then places the rod 29 in a substantially horizontal position and almost in contact with the inner surface 13 of the cover 12. Because the rod 29 is in substantial contact with the inner surface 13, the hose will not slip from the rod. When the cover is opened, the weight of the hose will cause the plate 26 to continue to pivot downward, thus automatically dumping the loops of hose out of the storage compartment 13.

It is also to be noted in FIG. 6 that the upper portion of the end walls 11b of storage compartment 11 are provided with two openings 22 through which fasteners may be inserted to secure the respective walls of the cabinet to external supporting means, as will be described subsequently.

Figure 3:
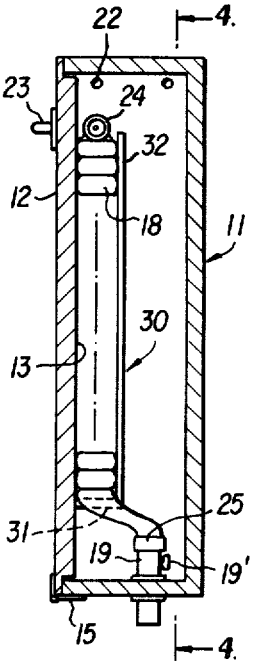
FIG. 3 is a partial cross-section of the present invention showing another embodiment for storing the hose.
Figure 4:
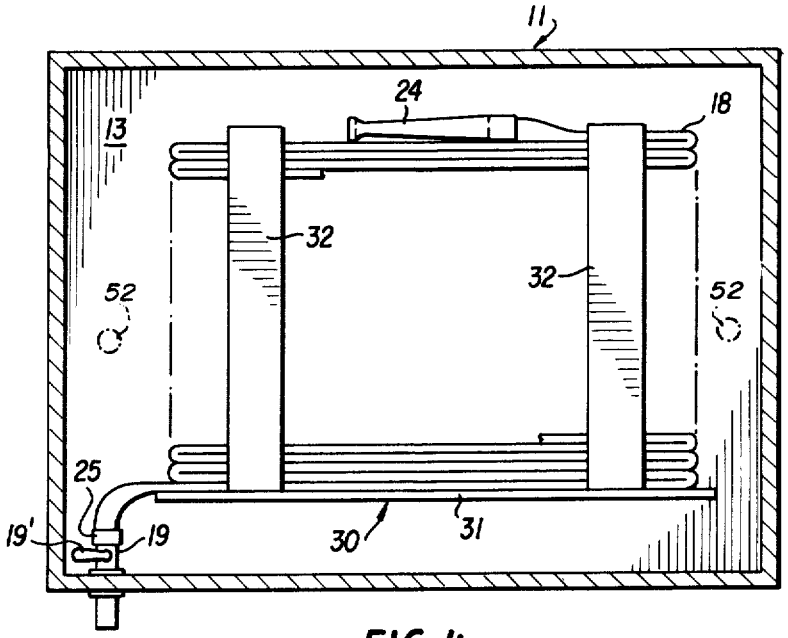
FIG. 4 is a front elevation view of the invention as seen along plane 3—3 to 4—4 in FIG. 3.

FIGS. 3 and 4 show yet another embodiment of the present invention relating principally to the storage of the hose. It will be seen in these figures, that the inner surface 13 of cover 12 has secured thereto in its lower portion, a hose support assembly 31. This assembly comprises a horizontal storage shelf 31 and at least one planar vertical member 32 attached to the outer portion of plate 31 to provide a guide so that the hose may be folded horizontally and placed on a shelf 31 as seen in these figures. However, while FIG. 4 discloses the use of two of these vertical retaining members 32, a single retaining member of sufficient width would be satisfactory. Otherwise, the hose storage cabinet is essentially the same as seen in FIG. 1. It will be noted that in FIG. 4, as well as in FIG. 1 and FIG. 5, that the water inlet conduit 19 is provided with a diverter valve 19' which conceivably should be of the simple lever type to control the flow of water into the hose.

Figure 5:
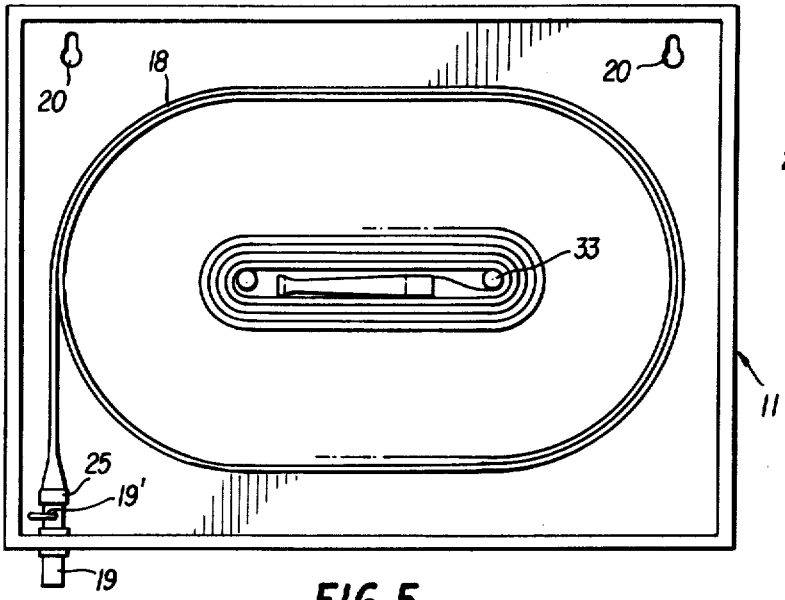
FIG. 5 is a front elevation of yet another embodiment of the present invention.
Figure 8:
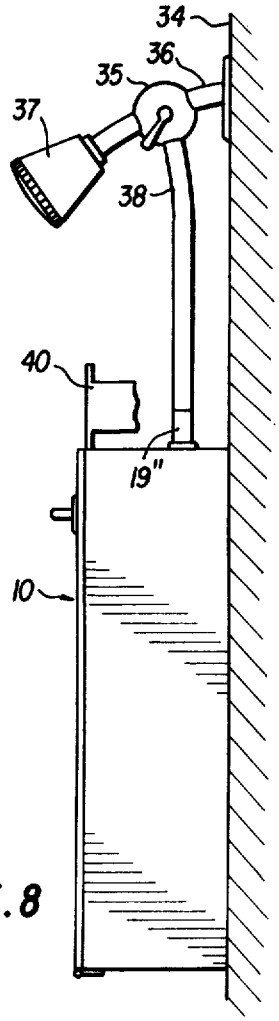
FIG. 8 is an end view of another embodiment of the present invention.

In FIG. 5, it will be seen that the hose 18 is wound into a loose circular coil which is then elongated and then placed on the supporting posts 33. These posts may be vertical to the back wall of the storage cabinet and provided with enlarged outer ends or upturned ends to prevent the hose from sliding off the posts until needed. Alternatively, the supporting posts 33 may be angled upwardly in a manner similar to that shown for hose supporting rods in FIGS. 2 and 6, although in such instances it is intended that they would be secured to the back wall 11a of the storage compartment 11. FIG. 8 discloses the present invention as it might be mounted on the exterior surface of a wall in a bathroom, in the shower-tub area. In this instance, the water supply conduit 19'' in upper wall of the storage cabinet is utilized, and a diverter valve assembly 35 is inserted between the shower supply pipe 35 and the shower head 37. The diverter valve assembly 35 is connected to the water supply conduit 19'' by a tubular conduit 38. The conduit may be a rigid member or may be of the flexible type, which also is readily available.

It is readily apparent that the present invention is best installed in a portion of an occupied building which is immediately adjacent to a water supply. In occupied spaces or units it would most logically be installed in a bathroom or kitchen or both, depending upon the particular construction or installation of a water supply in such a unit. If the present invention were to be installed in units under construction, it is considered preferable to install it between the wall studs by the means disclosed or whichever means would be indicated. The depth of the cabinet of the present invention need be only sufficient to cover the width of the hose and conceivably the overall dimensions could be as small as 2–3 inches. The cabinet would be of a length sufficient to be secured between wall studs and the height would be such as necessary to hold the amount of hose determined to be most practical. After consideration of the distances over which the hose might have to be drawn in order to bring the water supply to the source of a fire, it is suggested that a 50 foot length of hose would be generally adequate to reach most occupied spaces. Such a length of hose is presently being manufactured in the flat form and sold under the trademarks of TORO and Black & Decker. The cabinet of the present invention can be manufactured of metal or plastic material. Considering the fact that after use there is likely to be a problem with the presence of water, it is believed that manufacture from suitable thermoplastic materials would be most practical, although such materials in no way restrict the principle of the present invention.

While it has been described above that installation would preferably be by recessing the cabinet into a wall in the instance of units under construction so that the water supply would be easily obtained from the water conduits also being installed in the walls, and while FIG. 8 discloses an installation of the present invention on existing walls by use of a diverter valve assembly and a conduit connecting the diverter valve assembly with the cabinet, it is also considered possible that where the water conduits within a wall are readily accessible, that the unit could be mounted on the outer surface of wall and the connections made to the internal conduits. In such instances, when the cabinet is installed on the outer surface of a wall, the upper surface of the cabinet could serve as a shelf and rail 40, as suggested in FIG. 8, could be installed thereon to assist in the retention of articles placed on the thus-created shelf.

While the present invention has been illustratively shown to use a water supply conduit 19 as a component within the storage compartment 11, it is within the scope of the invention to provide merely openings in either or both end walls as shown in phantom at 41 in FIG. 6 or in the back wall of storage compartment 11 as shown in phantom at 52 in FIG. 4.

With the present invention, when a fire is discovered, the cover door of the cabinet is opened by grasping the handle 23 and allowed to fall freely. The hose is then quickly removed from the storage pegs 16 as seen in FIG. 1 or 33 in FIG. 5, or falls upon the floor when the hose is stored in the embodiments of FIGS. 6 and 7 and FIGS. 3 and 4. The cabinet diverter valve 19' (and valve 35 in FIG. 8) is then turned on and the hose, thus being on the floor, quickly fills with water while being dragged to the fire. The single lever nozzle 24 is actuated and the water then can be directed at the fire, its base, and the area around the fire. The present invention permits the combating of a fire from a distance which would prevent the clothing of the person combating the fire from becoming ignited. The hose is of such light weight that, even when filled with water, it can easily be dragged to the scene of the fire by a child, an elderly person or a partially handicapped person or a person in a wheelchair.

Modifications in the storage of hose and connections to water supply may occur to those of skill in the art. As an example, the hose previously mentioned is commercially available on a reel arrangement with the hose being rolled up inside the reel. Such a reel could be installed within the cabinet and made pivotal about a vertical axis for withdrawal of the hose. However, it is believed that such a storage would not make the entire length of hose available as quickly as the storage means described herein. Additionally, the water cannot be turned on until the hose has been completely withdrawn from the reel. Such a hose storage means is within the scope of the present invention. It would also be within the scope of the present invention to fixedly mount the pegs 16 on the back wall 11*a*. In such an instance, the nozzle end portion of the hose would be passed across the front of the loops of the hose and then under the loops with the nozzle placed in the support assembly 42. Removing the nozzle from the assembly and pulling outwardly will cause the loops of hose to be drawn quickly from the pegs.

What is claimed is:

1. A fire fighting device for installation in spaces having a pressurized water supply comprising:

a storage cabinet having a plurality of means therein and thereon for attaching said cabinet to a supporting structure in an upright position;

said cabinet being formed by a storage compartment with a tightly fitting cover therefor hingedly attached along the lower side of said compartment;

the compartment further having water inlet and control means therein for connection to said water supply; and said cabinet having therein quick release means for storing a length of flexible plastic hose, one end of which is connected to said water inlet and control means, the other end having a nozzle thereon, wherein said quick release and storage means comprises a support plate pivotally attached to the upper portion of the back wall of the installed cabinet, a plurality of upwardly sloping pegs to support an equal plurality of loops of said hose, and catch means pivotally mounted above said support plate and a catch actuating rod attached to the upper portion of the inner surface of said cover whereby when said cover is closed, said actuating rod will release said catch from said support plate to allow said plate to pivot forward until said pegs come in contact with the inner surface of said closed cover thereby retaining said hose on said pegs until such time as said cover is opened when said support plate will pivot forward to discharge said loops of hose from said cabinet.

2. The device according to claim 1 further comprising diverter valve means for insertion into the water supply line of a conventional bathroom shower fixture and conduit means connecting said diverter means with said water inlet and control means in said cabinet.

* * * * *